US006587650B2

(12) United States Patent
Yokoi et al.

(10) Patent No.: US 6,587,650 B2
(45) Date of Patent: Jul. 1, 2003

(54) ELECTROPHOTOGRAPHIC IMAGE FORMING APPARATUS, PROCESS CARTRIDGE, AND DEVELOPING DEVICE HAVING DEVELOPER AMOUNT DETECTOR

(75) Inventors: Akiyoshi Yokoi, Shizuoka (JP); Toru Oguma, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/912,555

(22) Filed: Jul. 26, 2001

(65) Prior Publication Data

US 2002/0025177 A1 Feb. 28, 2002

(30) Foreign Application Priority Data

Jul. 28, 2000 (JP) ..... 2000-228788
Jul. 28, 2000 (JP) ..... 2000-228797

(51) Int. Cl.[7] ..... G03G 15/08
(52) U.S. Cl. ..... 399/27
(58) Field of Search ..... 399/27, 30, 61, 399/62, 103, 105, 111

(56) References Cited

U.S. PATENT DOCUMENTS 5,966,568 A * 10/1999 Numagami et al. .... 222/DIG. 1
6,266,464 B1 * 5/2001 Suwa et al. ..... 399/254
6,397,017 B1 * 5/2002 Sakai et al. ..... 399/27
6,400,914 B1 * 6/2002 Noda et al. ..... 399/111

FOREIGN PATENT DOCUMENTS

JP 2001092232 A * 4/2001 ..... G03G/15/08
JP 2001117344 A * 4/2001 ..... G03G/15/08

* cited by examiner

*Primary Examiner*—Robert Beatty
(74) *Attorney, Agent, or Firm*—Fitzpatrick, Cella, Harper & Scinto

(57) ABSTRACT

In a developing device, process cartridge, and the like, including a developer amount detector for detecting a developer amount by detecting a change in capacitance among a plurality of electrodes, a developer is circulated and supplied in an optimal manner among the electrodes constituting the developer amount detector. The lower end portion on the upper side of an opening is above the lower end portion of a second electrode. With the opening formed in this manner, when toner in a developer frame is fed among the electrodes by a toner feeding member, the toner is urged into the developing frame without being interfered with by the lower end portion on the upper side of the opening. Ideal toner circulation and toner supply can be performed, and a detection error can be decreased.

20 Claims, 7 Drawing Sheets

ELECTROPHOTOGRAPHIC IMAGE FORMING APPARATUS, PROCESS CARTRIDGE, AND DEVELOPING DEVICE HAVING DEVELOPER AMOUNT DETECTOR

BACKGROUND OF THE INVENTION

1. Field of the Invention

The present invention relates to an electrophotographic image forming apparatus, a process cartridge, a developing device, and a developer frame.

An electrophotographic image forming apparatus forms an image on a recording medium by using the electrophotographic image forming process. An example of the electrophotographic image forming apparatus includes an electrophotographic copying machine, an electrophotographic printer (e.g., a laser beam printer or LED printer), a facsimile device, and a word processor.

A process cartridge is comprised of charging means, developing means or cleaning means, and an electrophotographic photosensitive drum that are integrally formed into a cartridge, which is detachably mountable in an electrophotographic image forming apparatus main body. Alternatively, a process cartridge is comprised of at least one of charging means, developing means, and cleaning means, and an electrophotographic photosensitive drum that are integrally formed into a cartridge, which is detachably mountable in an electrophotographic image forming apparatus main body. Alternatively, a process cartridge is comprised of at least developing means and an electrophotographic photosensitive drum that are integrally formed into a cartridge, which is detachably mountable in an electrophotographic image forming apparatus main body.

2. Description of the Related Art

An electrophotographic image forming apparatus using the electrophotographic image forming process employs a process-cartridge method in which an electrophotographic photosensitive member and process means that acts on the electrophotographic photosensitive drum are integrally formed into a cartridge, and the cartridge is detachably mountable in an electrophotographic image forming apparatus main body. According to the process-cartridge method, since the apparatus can be maintained by the user himself or herself without asking for a person in charge of maintenance, the operability can be greatly improved. For this reason, the process-cartridge method is widely used in the field of electrophotographic image forming apparatus.

Some electrophotographic image forming apparatuses employing the process-cartridge method have developer amount detecting means for informing the user that the developer is consumed, so that the user can exchange the cartridge by himself, as described above. One developer amount detecting means employs a method of detecting the developer amount by detecting a change in capacitance between electrodes arranged in the process cartridge.

Regarding the arrangement of the electrodes, an arrangement in which an electrode rod is arranged at a predetermined distance from a developer bearing member and the capacitance between the electrode rod and the developer bearing member is detected, an arrangement in which opposing electrode plates are arranged at positions between which the developer can enter and the capacitance between the electrode plates is detected, and an arrangement as a combination of the above two arrangements are available.

Each one of the developer amount detecting means described above detects a change in capacitance caused by the amount of developer which enters between the electrodes. Thus, the detection precision is largely influenced by the circulation of the developer.

The present invention is made by further developing the related art described above.

SUMMARY OF THE INVENTION

It is an object of the present invention to provide an electrophotographic image forming apparatus, a process cartridge, a developer container, and a developing device, in which a developer can be circulated and supplied in an optimal manner between electrodes constituting developer amount detecting means, which detects the developer amount by detecting a change in capacitance between the electrodes.

It is another object of the present invention to provide a developing device, a developer container, a process cartridge, and an electrophotographic image forming apparatus in which the developer amount can be detected with a high precision.

It is still another object of the present invention to provide, in a process cartridge detachably mountable in an electrophotographic image forming apparatus main body, a developing device, a developer container, a process cartridge, and an electrophotographic image forming apparatus, comprising an electrophotographic photosensitive member, developing means for developing a latent image formed on the electrophotographic photosensitive member by using a developer, a developer frame for containing the developer which visualizes the latent image formed on the electrophotographic photosensitive member and supplying the developer to the developing means through an opening, a first electrode, and a second electrode provided in a direction of the developer frame to oppose the first electrode, wherein the first and second electrodes are arranged at such positions that the developer can enter therebetween, and a capacitance between the second and first electrodes, which is generated when a voltage is applied to the second electrode, is detected, thereby detecting the developer amount, and the developer frame is arranged such that a lower end portion thereof on an upper side of the opening is above a lower end of the second electrode.

It is still another object of the present invention to provide an electrophotographic image forming apparatus, a process cartridge, a developing device, or a developer container, in which an unstable substance other than a developer is prevented from being present between electrodes, so that a developer amount detection error is minimized.

It is still another object of the present invention to provide, in a process cartridge detachably mountable in an electrophotographic image forming apparatus main body, a process cartridge, a developing device, a developer container, and an electrophotographic image forming apparatus, comprising an electrophotographic photosensitive member, developing means for developing a latent image formed on the electrophotographic photosensitive member by using a developer, a developer frame for containing the developer which visualizes the latent image formed on the electrophotographic photosensitive member and supplying the developer to the developing means through an opening, a seal member attached to the developer frame and adapted to close the opening of the developer frame, thereby sealing the developer, a first electrode, and a second electrode provided in a direction of the developer frame to oppose the first electrode. The first and second electrodes are arranged at such positions that the developer can enter therebetween, and a capacitance between the second and first electrodes, which is generated when a voltage is applied to the second electrode, is detected, thereby detecting the developer amount. The seal member is removed leaving an attached portion thereof which is attached to the developer frame, so that the opening is unsealed and the developer can be supplied to the developing means. The attaching portion of the seal member on an upper side, which is left after unsealing, is above a lower end of the second electrode.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

A process cartridge according to an embodiment of the present invention, and an electrophotographic image forming apparatus using the process cartridge will be described.

(Explanation of Entire Image Forming Apparatus)

Figure 1:
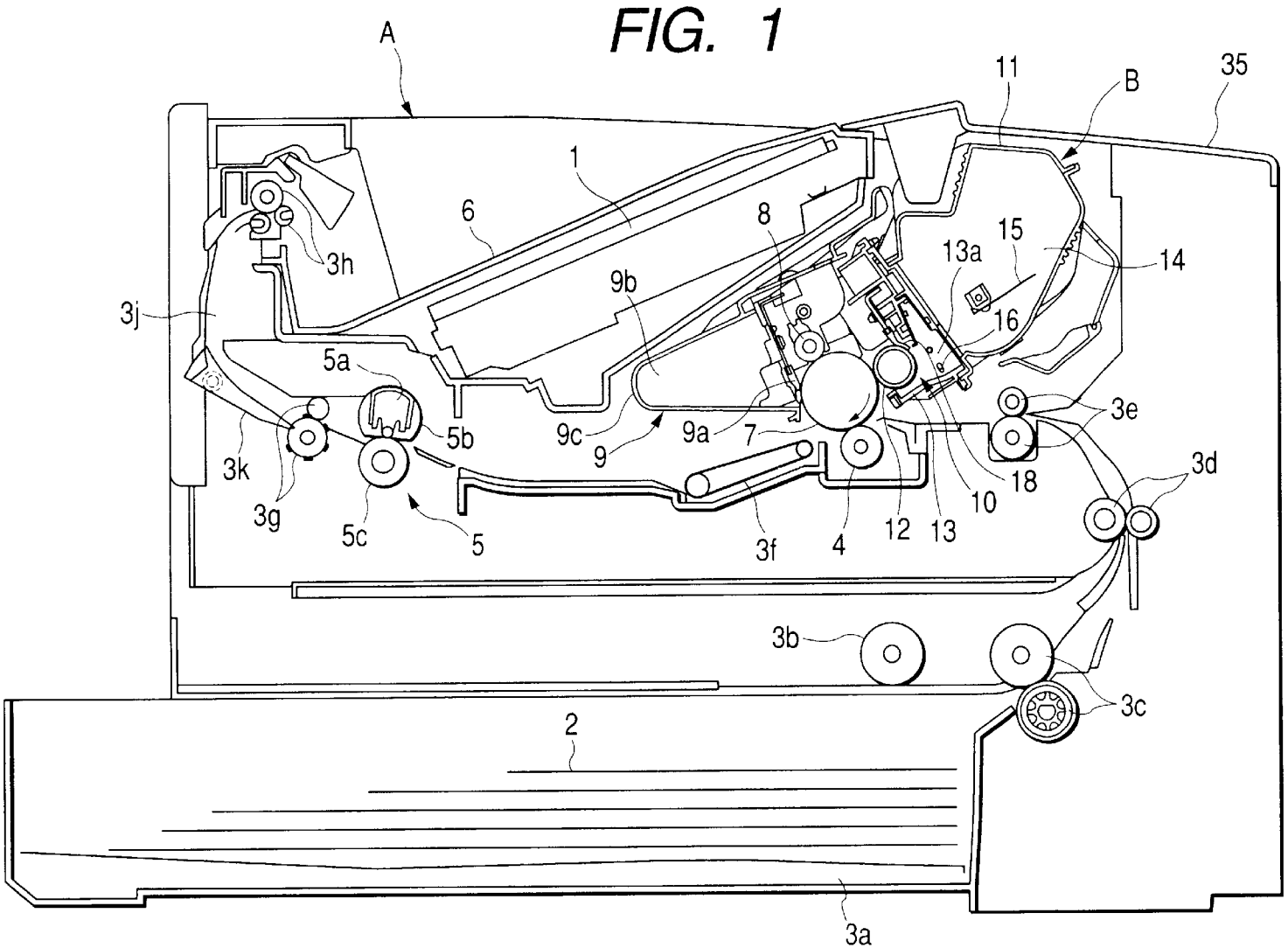
FIG. 1 is a schematic longitudinal sectional view of an electrophotographic image forming apparatus A in which a process cartridge B is mounted.

First, the entire arrangement of the electrophotographic image forming apparatus (to be referred to as an image forming apparatus A hereinafter) will be described with reference to FIG. 1. FIG. 1 is a schematic longitudinal sectional view of the image forming apparatus A in which a process cartridge B is mounted.

A drum-shaped electrophotographic photosensitive member (to be referred to as a photosensitive drum 7 hereinafter) as an example of an image bearing member is provided in the process cartridge B in the image forming apparatus A. The photosensitive drum 7 is charged by a charging roller 8 serving as charging means, and is irradiated with a laser beam corresponding to image information by optical means 1 having a laser diode, a polygon mirror, a lens, and a reflecting mirror, to form a latent image corresponding to the image information on the photosensitive drum 7. The latent image is developed by developing means 10 to become a toner image as a visual image.

The developing means 10 is comprised of a developing sleeve 12 serving as a developer bearing member for feeding a developer (toner) to the photosensitive drum 7, and a developing blade 18 serving as a regulating member for regulating the amount of developer adhering to the surface of the developing sleeve 12. A developing frame 13 for holding the developing sleeve 12 and the developing blade 18, and a developer frame 11 (called a developer container or a toner container as well) containing the developer are connected with each other to form a developing unit 20 as a developing device.

The developing sleeve 12 has an outer surface that forms a substantially cylindrical shape, is rotatably supported by the developing frame 13, and incorporates a stationary magnet 17 (not shown) therein. The developing blade 18 is disposed substantially parallel to the developing sleeve 12 at an appropriate distance from the developing sleeve 12. The developer frame 11 forms a toner containing portion 14 for containing the toner as the developer, and has a toner feeding member 15 for feeding the toner in the toner containing portion 14. The toner feeding member 15 is formed of a flexible, elastic plastic sheet or the like. The developer frame 11 is arranged adjacent to the developing frame 13, and supplies the toner in the toner containing portion 14 to the developing frame 13.

The developing frame 13 has a developing chamber 13*a*, and the toner in the toner containing portion 14 adjacent to the developing chamber 13*a* is fed to the developing chamber 13*a* by rotation of the toner feeding member 15. The developing frame 13 has a rotatable toner agitating member 16 in the vicinity of the developing sleeve 12. The toner in the developing chamber 13*a* which is fed from the toner containing portion 14 is circulated by the rotation of the toner agitating member 16. Since the toner has magnetic properties and the developing sleeve 12 incorporates the stationary magnet 17 therein, the toner adheres to the developing sleeve 12.

When the developing sleeve 12 is rotated, the toner is conveyed and the toner is imparted with triboelectrification charge induced by the developing blade 18 and formed into a toner layer with a predetermined thickness, and the toner layer is conveyed to the developing region of the photosensitive drum 7. The toner supplied to the developing region is transferred to the latent image on the photosensitive drum 7, and forms a toner image on the photosensitive drum 7. The developing sleeve 12 is connected to a developing bias circuit provided to the main body of the image forming apparatus A. Usually, a developing bias voltage obtained by superimposing a DC voltage on an AC voltage is applied to the developing sleeve 12.

In synchronism with formation of the toner image, a recording medium 2 set on a feed cassette 3*a* is transported to the transfer position by a pickup roller 3*b*, transporting roller pairs 3*c* and 3*d*, and a registration roller pair 3*e*. A transfer roller 4 serving as transfer means is arranged at the transfer position. When a voltage is applied to the transfer roller 4, the toner image on the photosensitive drum 7 is transferred to the recording medium 2.

The recording medium 2 on which the toner image has been transferred is transported to fixing means 5 by a transport guide 3*f*. The fixing means 5 has a driving roller 5*c* and a fixing roller 5*b* incorporating a heater 5*a* therein, and applies heat and pressure to the recording medium 2 passing through the fixing means 5, thereby fixing the transferred toner image on the recording medium 2.

The recording medium 2 with the fixed toner image is transported by a delivery roller pair 3*g*, and is delivered to a delivery tray 6 by a delivery roller pair 3*h* through a surface reverse path 3*j*. The delivery tray 6 is formed on the upper surface of the image forming apparatus A. Alternatively, the recording medium 2 can be delivered by operating a swingable flapper 3*k* without passing through the surface reverse path 3*j*. In this embodiment, the pickup roller 3*b*, the transporting roller pairs 3*c* and 3*d*, the registration roller pair 3*e*, the transport guide 3*f*, and the delivery roller pairs 3*g* and 3*h* make up the transporting means.

After the toner image is transferred to the recording medium 2 by the transfer roller 4, the toner remaining on the photosensitive drum 7 is removed by cleaning means 9, and the photosensitive drum 7 is subjected to the next image forming process. The cleaning means 9 is comprised of an elastic cleaning blade 9*a* abutting against the photosensitive drum 7, and a waste toner reservoir 9*b* for containing the residual toner. The waste toner reservoir 9*b* is formed of a cleaning frame 9*c*, that supports the cleaning blade 9*a*. The cleaning means 9 scrapes off the residual toner on the photosensitive drum 7 with the cleaning blade 9*a* and collects the residual toner in the waste toner reservoir 9*b*.

(Explanation of Process Cartridge)

Figure 2:
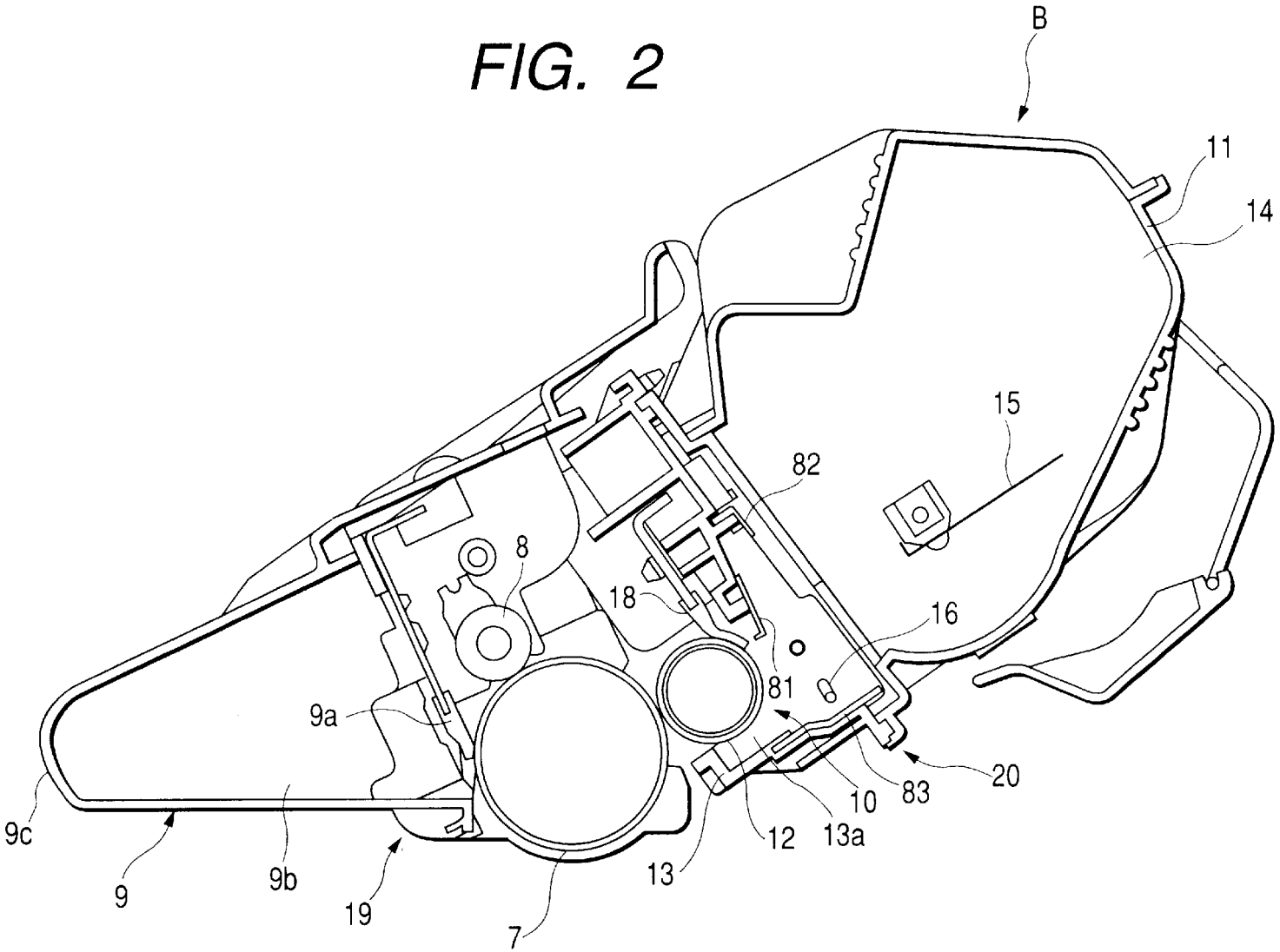
FIG. 2 is a longitudinal sectional view of the process cartridge B of the present invention.

As shown in FIG. 2, according to this embodiment, in the process cartridge B, the developer frame 11 is welded to the developing frame 13 having the developing means 10, to integrally form the developing unit 20 (developing device). The developer frame 11 forms the toner containing portion 14 for containing the toner, and the toner feeding member 15 is rotatably supported in the toner containing portion 14. The developing frame 13 holds the developing sleeve 12 and the developing blade 18 serving as the developing means 10.

The cleaning means 9 such as the cleaning blade 9*a*, the photosensitive drum 7, and the charging roller 8 make up a cleaning unit 19.

The process cartridge B is formed into a cartridge by integrally connecting the developing unit 20 and the cleaning unit 19.

Figure 3:
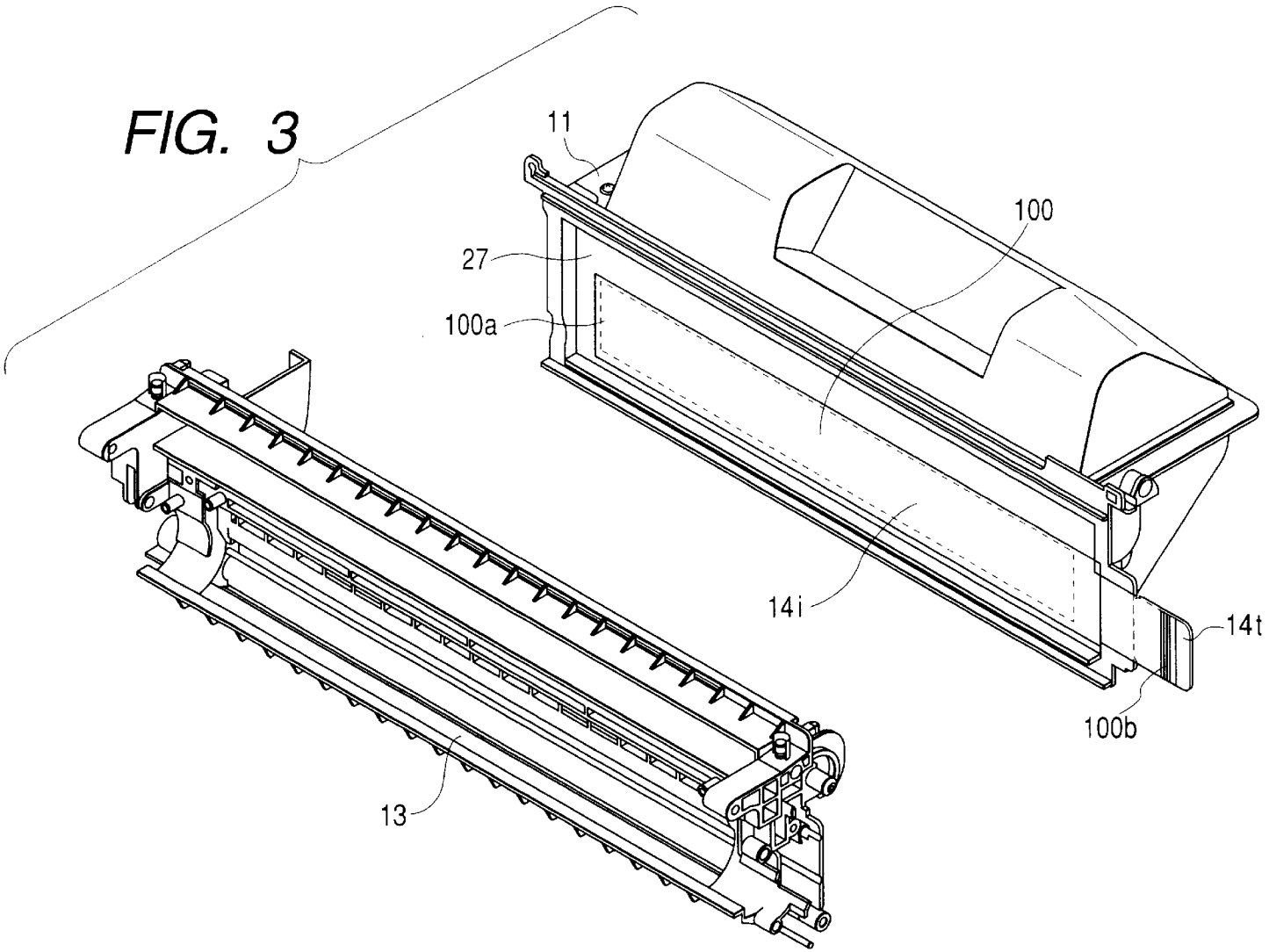
FIG. 3 is a perspective view showing a state wherein a seal member is adhered to the opening of a developer frame.

As shown in FIG. 3, that portion of the developer frame 11 which is bonded to the developing frame 13 has an opening 14*i* through which the toner is fed from the toner containing portion 14 into the developing frame 13. In a new process cartridge B, the opening 14*i* is closed with a flexible seal member 100 so the toner in the developer frame 11 will not leak during the physical distribution of the process cartridge. FIG. 3 shows a state wherein the opening 14*i* is closed with the seal member 100.

Figure 7:
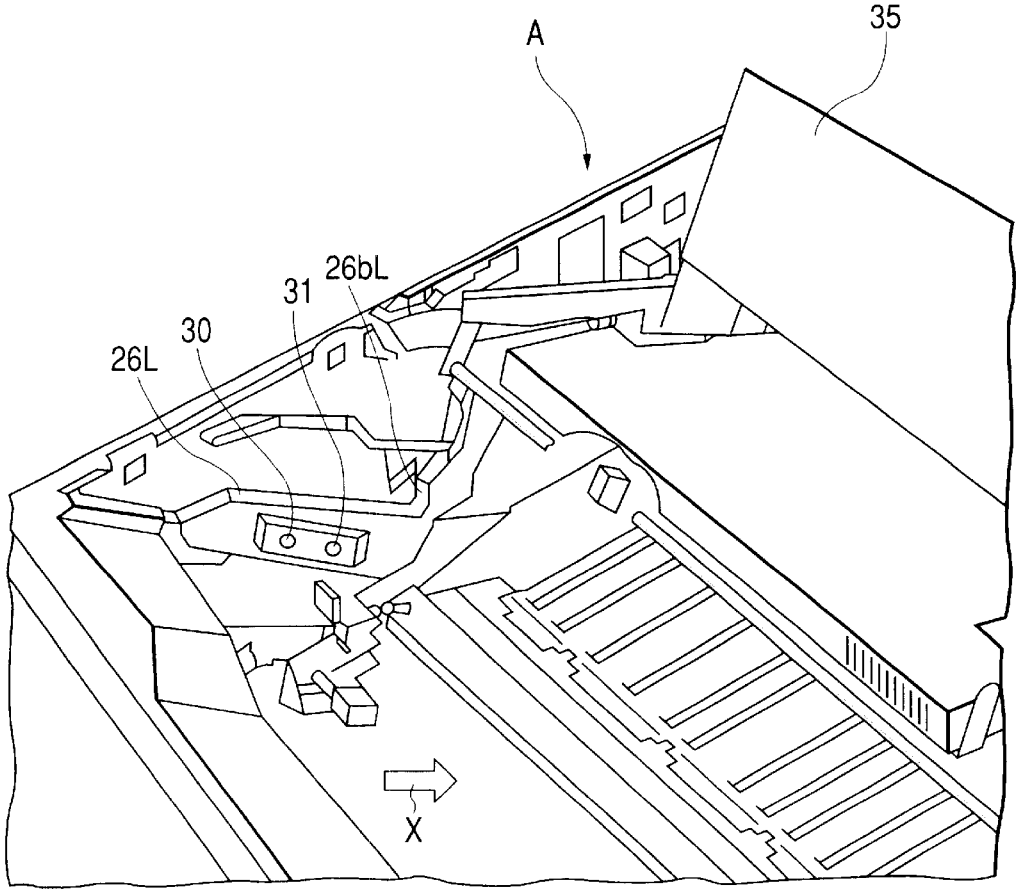
FIG. 7 is a perspective view showing a state wherein an opening/closing member for the image forming apparatus is open.

How to mount the process cartridge B in and dismount the process cartridge B from the image forming apparatus A will be described with reference to FIG. 7. FIG. 7 is a perspective view showing a state wherein an opening/closing member 35 of the image forming apparatus A is open. When the opening/closing member 35 is open from the image forming apparatus A about a hinge 35*a* (not shown) as the center, left and right guide rails 26L and 26R (26R is not shown) extending downward in the forward direction are seen on the left and right inner walls of the image forming apparatus A. Left and right cylindrical guides 7bL and 7bR (not shown) coaxial with the photosensitive drum 7, and elongated positioning guides 7*c* (not shown) behind the cylindrical guides 7bL and 7bR are inserted in the guide rails 26L and 26R, and the cylindrical guides 7bL and 7bR are fitted in positioning grooves 26bL and 26bR (26bR is not shown) of the image forming apparatus A, thereby mounting the process cartridge B in the image forming apparatus A.

Conversely, to remove the process cartridge B mounted in the image forming apparatus A, the process cartridge B is removed along the guide rails 26L and 26R in accordance with a procedure opposite to that described above.

(Explanation of Seal Member)

The seal member 100 for closing the opening 14*i* will be described with reference to FIGS. 3 and 4.

For example, the seal member 100 is formed by laminating PET (polyethylene terephthalate) films on the upper and lower surfaces of an Al (aluminum) film. A new seal member 100 is adhered to close the opening 14*i* of the developer frame 11, as shown in FIG. 3. The seal member 100 covers the opening 14*i* formed in the developer frame 11, and is fixed to the developer frame 11 by welding so as to surround the opening 14*i*. The seal member 100 is folded back at its one end portion 100*a* in the longitudinal direction, and its grip end portion 100*b* is run off one end of the opening 14*i*. The grip end portion 100*b* is adhered to a grip member 14*t* serving as a hand grip. The grip member 14*t* is integrally formed with the developer frame 11, and is particularly thin at its portion connected to the developer frame 11, so that the connected portion is frangible and the grip member 14*t* is separable from the developer frame 11. Upon packing, the grip member 14*t* is folded at substantially 90° so the space in the longitudinal direction can be minimized.

Figure 4:
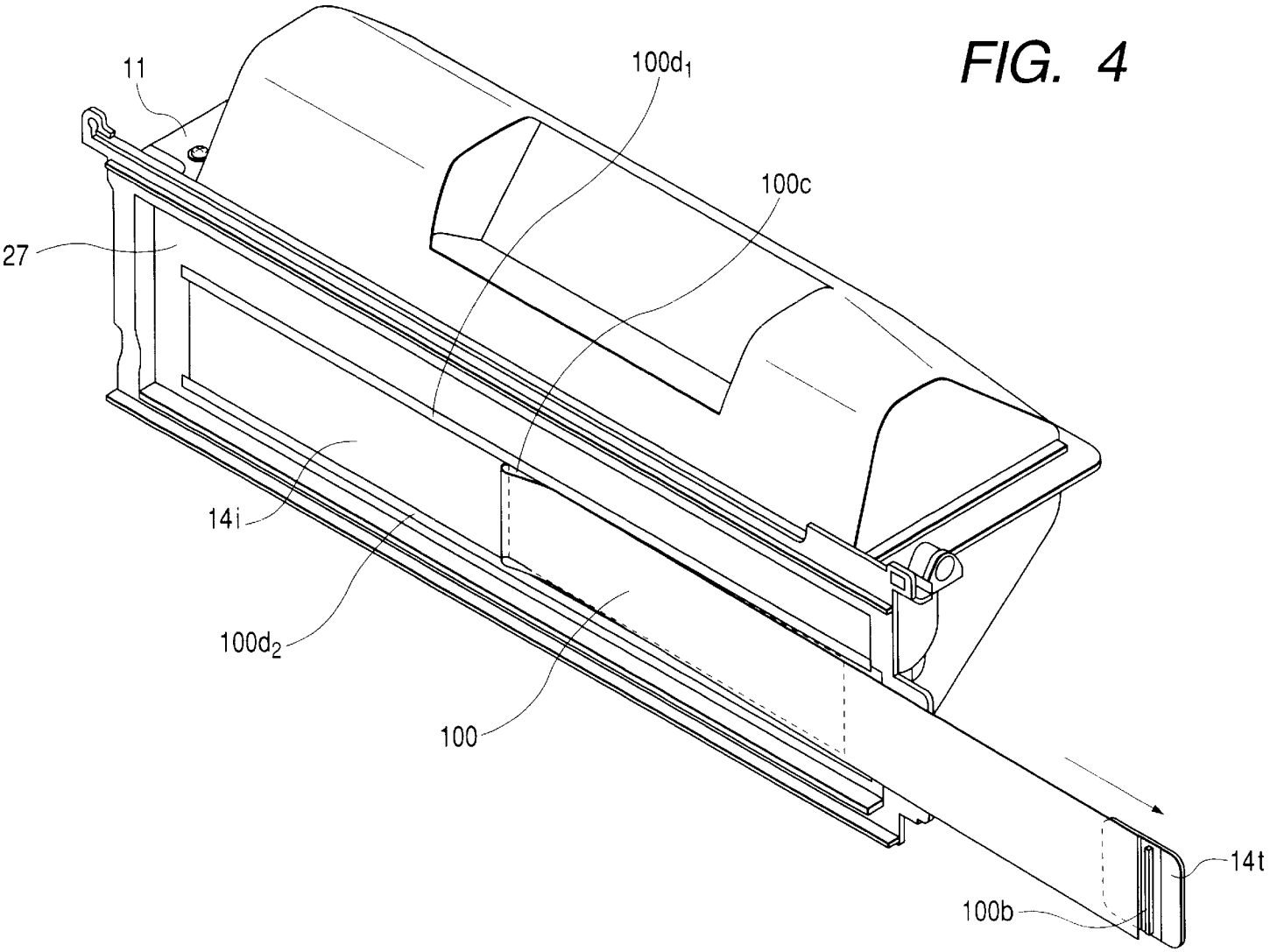
FIG. 4 is a perspective view showing a state wherein the seal member is being torn up and removed from the developer frame.

The seal member 100 has notches 100*c* in its one laminated PET film so the opening 14*i* can be unsealed by tearing, as shown in FIG. 4. To remove the seal member 100, the seal member 100 is torn along the notches 100*c*, thereby unsealing the opening 14*i* of the developer frame 11.

To feed the toner contained in the toner containing portion 14 into the developing frame 13, first, the base side of the grip member 14*t*, to which the grip end portion 100*b*, projecting to the outside of the process cartridge B, of the seal member 100, is adhered, is separated from the developer frame 11. As shown in FIG. 4 (which shows a state of the developer frame 11 before the developer frame 11 and developing frame 13 are connected), after separating, when the operator pulls the grip member 14*t* with his hand, the seal member 100 is torn along the notches 100*c* about the folded portion as the fulcrum, so the opening 14*i* of the developer frame 11 is unsealed, and the toner can be fed from the toner containing portion 14 into the developing frame 13.

(Explanation of Developer Amount Detecting Means)

In the above embodiment, the process cartridge B has a developer amount detecting means for detecting the residual amount of the toner as the toner in the developing chamber 13*a* is consumed. In this embodiment, as a measurement electrode member constituting the developer amount detecting means, the first, the second, and the third electrodes 81, 82, and 83 are provided to the developing frame 13, as shown in FIG. 2, to be substantially parallel to the developing sleeve 12. The first electrode 81 is provided in the vicinity of the developing sleeve 12 to extend along the developing sleeve 12, and the third electrode 83 is provided on the bottom of the developing frame 13. The first and third electrodes 81 and 83 are electrically connected to each other in the developing frame 13 and are set at the same potential.

The second electrode 82 is provided closer to the developer frame 11 than the first electrode 81, and is arranged at the upper portion of the developing frame 13 so as to oppose the first and third electrodes 81 and 83. The developer amount detecting means induces a capacitance between the first and second electrodes 81 and 82 by applying a voltage to either one. The toner amount is detected by measuring this capacitance. More specifically, when the toner enters between the electrodes, the capacitance between the electrodes changes. The toner amount can be detected by detecting this change. In this embodiment, the voltage is applied to the second electrode 82 to make the second electrode 82 the input side, and the first and third electrodes 81 and 83 the output side.

The first, second, and third electrodes 81, 82, and 83 are arranged at such positions that the toner conveyed from the developer frame 11 by the toner feeding member 15 can enter between them. When the toner amount in the process cartridge B is large, the toner is urged into the space surrounded by the respective electrodes by the toner feeding member 15, and accordingly the capacitance among the electrodes is kept high. As the process cartridge B is used, the toner is consumed, and the toner height between the second electrode 82 and the first and third electrodes 81 and 83 decreases, so the capacitance between the electrodes also decreases. The toner amount is successively detected from a decrease in capacitance.

Finally, when the toner in the vicinity of the distal end of the developing blade 18 which scrapes off the toner on the surface of the developing sleeve 12 is consumed, a blank area on an image occurs, and the toner runs out. In this embodiment, the developing bias voltage applied to the developing sleeve 12 is used as an input voltage, and the capacitance between the developing sleeve 12 and the first electrode 81 is also detected, thereby detecting the toner run-out state. In other words, the developer amount detecting means can successively detect the toner amount by detecting a change in capacitance among a plurality of electrodes.

(Explanation of Detecting Circuit)

Figure 5:
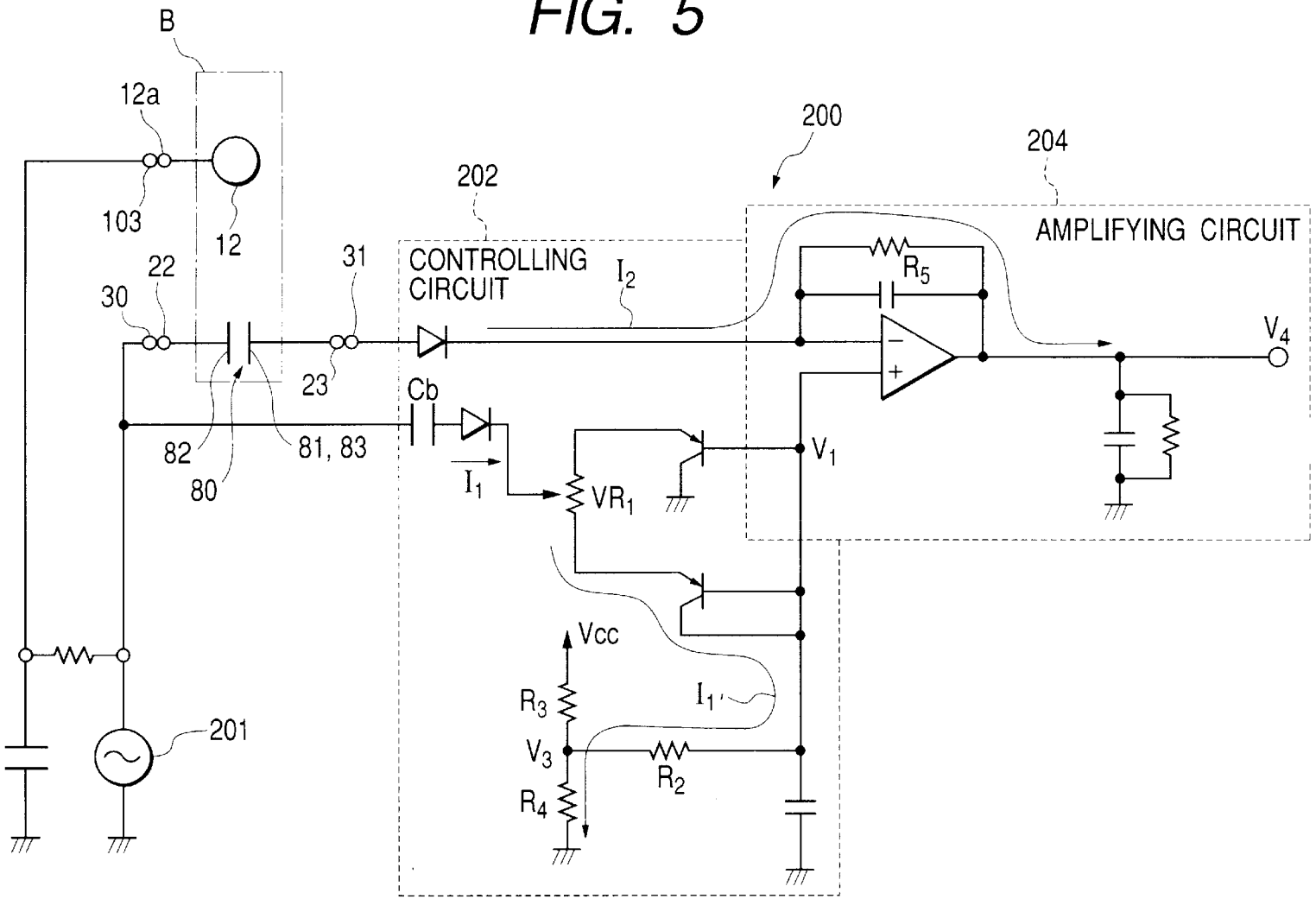
FIG. 5 is a circuit diagram showing an example of a developer amount detecting circuit for detecting the capacitance existing in developer amount detecting means.

FIG. 5 is a circuit diagram showing an example of a developer amount detecting circuit for detecting the developer amount in the image forming apparatus A and the process cartridge B.

A developer amount detecting circuit 200 is comprised of a detecting unit 80, a developing bias circuit 201, a controlling circuit 202, and an amplifying circuit 204. The detecting unit 80 is made up of the first, second, and third electrodes 81, 82, and 83 serving as the developer amount detecting means, and the developing sleeve 12, and induces a capacitance for detecting the toner amount. The detecting unit 80 is provided in the process cartridge B.

The developing bias circuit 201, the controlling circuit 202, and the amplifying circuit 204 are provided in the main body of the image forming apparatus A.

Electrical contacts 22 and 23 serving as electrical contacts with the image forming apparatus A are formed on the side surface of the frame of the process cartridge B. When the process cartridge B is mounted in the main body of the image forming apparatus A, the electrical contacts 22 and 23 respectively come into contact with electrical contacts 30 and 31 formed on the image forming apparatus A.

A capacitance Ca of the detecting unit 80 corresponds to the capacitance between the second electrode 82 and the first and third electrodes 81 and 83, and changes in accordance with the toner amount.

One input electrode of the detecting unit 80 as an impedance element is connected to the developing bias circuit 201 serving as the developing bias applying means. In this embodiment, the second electrode 82 serves as the input electrode, and is connected to the developing bias circuit 201 through the electrical contact 22 and the electrical contact 30 of the main body of the image forming apparatus A. The other electrode of the detecting unit 80 as the output side is connected to the controlling circuit 202. In this embodiment, the first and third electrodes 81 and 83 are connected to the controlling circuit 202 through the electrical contact 23 and the electrical contact 31 of the main body of the image forming apparatus A.

The process cartridge B has an electrical contact 12*a* electrically connected to the developing sleeve 12, and the image forming apparatus A has an electrical contact 103 electrically connected to the developing bias circuit 201. When the process cartridge B is mounted in the image forming apparatus A, the electrical contact 12*a* and the electrical contact 103 provided in the image forming apparatus A are electrically connected to each other, so that the developing bias voltage is applied from the developing bias circuit 201 of the image forming apparatus A to the developing sleeve 12 through the electrical contacts 103 and 12*a*.

The controlling circuit 202 has a reference capacitance element Cb, which, in turn, is connected to the developing bias circuit 201 in the image forming apparatus A. The reference capacitance element Cb sets a reference voltage $V_1$, serving as a reference in detection of the toner amount, by using an AC (alternating) current $I_1$ applied by the developing bias circuit 201. The controlling circuit 202 shunts the AC current $I_1$ applied to the reference capacitance element Cb with a volume $VR_1$, and adds a voltage drop $V_2$ across a resistor $R_2$ by a shunt AC current $I_1'$ to a preset voltage $V_3$ set by resistors $R_3$ and $R_4$, thereby determining the reference voltage $V_1$.

The amplifying circuit 204 has a comparator for calculating the differential voltage. An AC current $I_2$ applied to the detecting unit 80 is input to the amplifying circuit 204, and is output as a toner amount detection value $V_4$ ($=V_1-I_2\times R_5$). The residual toner amount is detected on the basis of the detection value $V_4$ as the difference from the reference voltage $V_1$. The operator (user) is informed of information on the residual toner amount detected in this manner by an indicating portion (not shown) or the like provided to the main body of the image forming apparatus A.

With the image forming apparatus A according to the present invention, when the residual toner amount in the process cartridge B is successively detected and the consumed toner amount is indicated on the basis of the information, the user can be prompted to prepare a new process cartridge or a supply cartridge. Furthermore, toner run-out detection information can prompt the user to exchange the process cartridge or to supply the toner.

According to the embodiment, the respective electrodes are fabricated from a nonmagnetic stainless steel material (SUS material) and formed on the developing frame 13 such that they will not adversely affect circulation of the toner. Alternatively, any electrodes can be employed as far as they are made of a nonmagnetic, electrically charging material such as an aluminum material or conductive resin. Conductive portions can be formed by forming, in two colors, a conductive coating layer or vapor deposition layer, or a conductive resin directly formed on the frame by subjecting the developing frame 13 to vapor deposition or printing. In this case, the attaching tolerance or component tolerance decreases when compared to a case wherein electrodes, made of separate members, are attached. As a result, the position precision can be improved.

(Explanation of Opening of Developer Frame)

As described above, the developer amount detecting means is arranged at a position where the toner conveyed by the toner feeding member 15 enters, and detects the residual toner amount when the toner is forced from the developer frame 11. For this reason, the opening 14*i* of the developer frame 11 should not interfere with entry of the toner.

For example, assume that a lower end portion 14*j* of the upper side of the opening 14*i* is under the lower end portion of the second electrode 82. In this case, the lower end portion 14*j* adversely affects circulation of the toner. The toner is not fed into the space surrounded by the respective electrodes. The capacitance then decreases, and the residual toner amount may be detected to be smaller than it really is. Conversely, the toner fed into the space surrounded by the respective electrodes may solidify there. Then, trouble may occur, e.g., some capacitance which indicates the presence of the toner may be erroneously detected not withstanding the absence of the toner.

Figure 6:
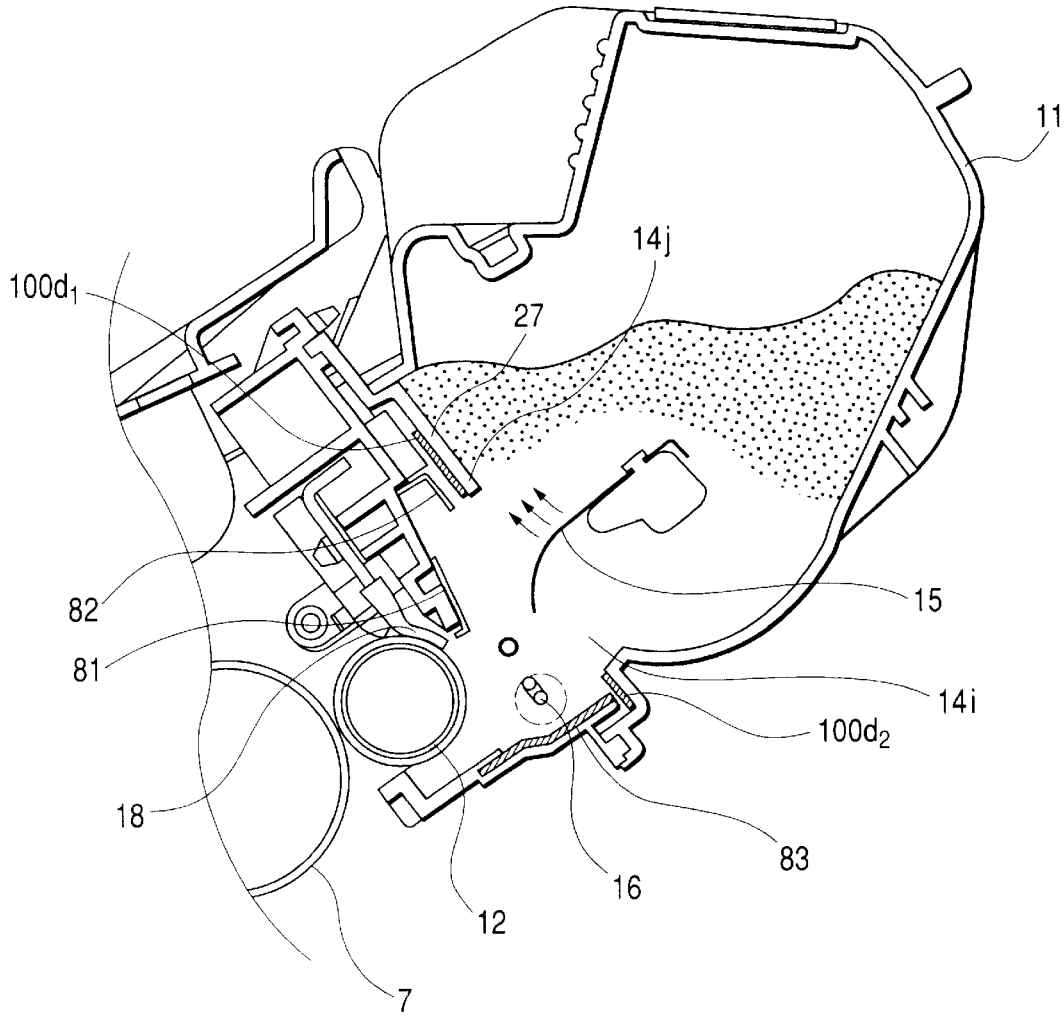
FIG. 6 is an enlarged longitudinal sectional view showing the developer frame and a developing frame of the process cartridge B.

Regarding this, in this embodiment, as shown in FIG. 6, the lower end portion 14*j* on the upper side of the opening 14*i* is arranged above the lower end of the second electrode 82.

The developer frame 11 has a wall 27 at its boundary with the developing frame 13. The wall 27 has the opening 14*i* for toner supply. The opening 14*i* is obtained by forming a substantially rectangular hole in the wall 27, and regulates toner supply from the developer frame 11 in accordance with the size and the arrangement of the opening 14*i*. According to the present invention, when forming the opening 14*i* in the wall 27 of the developer frame 11, it is arranged such that the lower end portion 14*j* of the wall 27 located on the upper side of the opening 14*i* is above the lower end of the second electrode 82 formed on the developing frame 13.

With the opening 14*i* formed in this manner, when the toner in the developer frame 11 is fed in a direction indicated by arrows in FIG. 6 upon the rotational motion of the toner feeding member 15, it is forced into the developing frame 13 without being interfered with by the lower end portion 14*j* on the upper side of the opening 14*i*, so that ideal toner circulation and toner supply can be performed. Since the toner can be appropriately supplied to between the first and second electrodes 81 and 82, a detection error by the developer amount detecting means can be minimized.

In this embodiment, the process cartridge B is obtained by integrally forming the photosensitive drum 7, serving as the image bearing member, and the developing means 10. However, the present invention is not limited to the process cartridge, but can be similarly applied to a developing device in which developing means 10 and the like form an integral developing unit 20.

According to the above embodiment, in the developing device, the process cartridge, and the like, having the developer amount detecting means for detecting the toner amount from a change in capacitance between the electrodes, the developer can be circulated and supplied in an optimal manner between the electrodes constituting the developer amount detecting means. As a result, a high-performance developing device, a process cartridge, and the like, in which a developer amount detection error is minimized, can be provided.

(Explanation of Seal Member Attaching Portion)

An attaching member for the seal member will be described.

As shown in FIG. 4, the seal member 100 is torn off along the notch 100*c* while leaving attaching portions $\mathbf{100}d_1$ and $\mathbf{100}d_2$ at the upper and lower portions of the opening 14*i* of the developer frame 11. The attaching portion $\mathbf{100}d_1$ is arranged on the upper side of the opening 14*i* of the toner containing portion 14, and is located on a surface opposing the second electrode 82, as shown in FIG. 6.

As described above, the developer amount detecting means is formed by arranging electrodes in the developing frame 13. A change in capacitance brought about by the toner present among the electrodes is measured, thereby detecting the residual toner amount. As described above, the seal member 100 is formed by, e.g., laminating PET (polyethylene terephthalate) films on the upper and lower surfaces of an Al (aluminum) film. Since aluminum is a dielectric, when an electric field is applied to it, it causes dielectric polarization. Therefore, when the attaching portion $\mathbf{100}d_1$ of the seal member 100 as the dielectric is located between the electrodes or in the vicinity of between the electrodes, a capacitance is undesirably induced in the attaching portion $\mathbf{100}d_1$ to adversely affect detection of the developer amount. This causes variations in residual toner amount detection.

For this reason, according to the present invention, the lower end portion of the attaching portion $\mathbf{100}d_1$ is arranged above the lower end portion of the second electrode 82, as shown in FIG. 6, so the attaching portion $\mathbf{100}d_1$ of the seal member 100 will not enter among the electrodes. More specifically, when attaching the seal member 100 to the developer frame 11, it is done such that the notch 100*c* of the seal member 100 is above the lower end portion of the second electrode 82.

More preferably, in the sectional view shown in FIG. 6, the attaching portion $\mathbf{100}d_1$ is arranged such that the lower end of the attaching portion $\mathbf{100}d_1$ is left above the extension of a straight line that connects the upper end of the first electrode 81 and the lower end of the second electrode 82.

With this arrangement, the attaching portion $\mathbf{100}d_1$ of the seal member 100 will not unstably move upon circulation of the toner to adversely affect residual toner amount detection. Thus, the developer amount can be appropriately detected, and variations in toner amount detection can be prevented.

In this embodiment, the process cartridge B is obtained by integrally forming the photosensitive drum 7, serving as the image bearing member, and the developing means 10. However, the present invention is not limited to the process cartridge, and can be similarly applied to a developing device in which a developing means 10 and the like form an integral developing unit 20.

As has been described above, according to the embodiment, in the electrophotographic image forming apparatus, the process cartridge, the developing device, or the developer container, having the developer amount detecting means for detecting the toner amount from a change in capacitance between the electrodes, an unstable substance other than the developer is prevented from being present among the electrodes, so that a developer amount detection error can be minimized.

According to the present invention described above, the developer amount can be detected with a high precision.

While the invention has been described with reference to the structure disclosed herein, it is not confined to the details set forth and this application is intended to cover such modifications or changes as may come within the purposes of the improvements or the scope of the following claims.

What is claimed is:

1. A process cartridge detachably mountable in a main body of an electrophotographic image forming apparatus, said process cartridge comprising:

an electrophotographic photosensitive member;

a developing roller for developing a latent image formed on said electrophotographic photosensitive member by using a developer;

a developer frame for containing the developer and having a supply opening, through which the developer is supplied to said developing roller;

a first electrode provided along a longitudinal direction of said developing roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that the main body detects a developer amount, and said developer frame is arranged such that a lower end portion on an upper side of said supply opening of said developer frame is above a lower end of said second electrode.

2. A developing device detachably mountable in a main body of an electrophotographic image forming apparatus and used for developing an electrostatic latent image formed on an electrophotographic photosensitive member, said developing device comprising:

a developing roller for developing the latent image formed on the electrophotographic photosensitive member by using a developer;

a developer frame for containing the developer and having a supply opening, through which the developer is supplied to said developing roller;

a first electrode provided along a longitudinal direction of said developing roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that the main body detects a developer amount, and said developer frame is arranged such that a lower end portion on an upper side of said supply opening of said developer frame is above a lower end of said second electrode.

3. An electrophotographic image forming apparatus for forming an image on a recording medium, said electrophotographic image forming apparatus comprising:

an electrophotographic photosensitive member;

a developing roller for developing a latent image formed on said electrophotographic photosensitive member by using a developer;

a developer frame for containing the developer and having a supply opening through which the developer is supplied to said developing roller;

a first electrode provided along a longitudinal direction of said developer roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that a main body of said electrophotographic image forming apparatus detects a developer amount, and said developer frame is arranged such that a lower end portion on an upper side of said supply opening of said developer frame is above a lower end of said second electrode.

4. A developer frame for a developing device, which is detachably mountable in a main body of an electrophotographic image forming apparatus to develop an electrostatic latent image formed on an electrophotographic photosensitive member by a developing roller, and has developer amount detecting means, having a first electrode provided along a longitudinal direction of said developing roller and a second electrode provided closer to a supply opening of said developer frame than said first electrode, said first and second electrodes being arranged at such positions that a developer can enter therebetween, for detecting a capacitance between said second and first electrodes which is generated when a voltage is applied to said second electrode so that the main body detects a developer amount, wherein said developer frame contains the developer and has said supply opening, through which the developer is supplied to said developing roller, and said developer frame is arranged such that a lower end portion on an upper side of said supply opening of said developer frame is above a lower end of said second electrode.

5. A process cartridge detachably mountable in a main body of an electrophotographic image forming apparatus, said process cartridge comprising:

an electrophotographic photosensitive member;

a developing roller for developing a latent image formed on said electrophotographic photosensitive member by using a developer;

a developer frame for containing the developer and having a supply opening, through which the developer is supplied to said developing roller;

a seal member attached to said developer frame and adapted to close said supply opening of said developer frame, thereby sealing the developer in said developer frame;

a first electrode provided along a longitudinal direction of said developing roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that the main body detects a developer amount, said seal member is removable, leaving an attached portion thereof when removed which is attached to said developer frame, so that said supply opening is unsealable and the developer can be supplied to said developing roller when said seal member is removed, and an upper side of the attached portion of said seal member, which is left after unsealing, is above a lower end of said second electrode.

6. A developing device detachably mountable in a main body of an electrophotographic image forming apparatus and used for developing an electrostatic latent image formed on an electrophotographic photosensitive member, said developing device comprising:

a developing roller for developing the latent image formed on the electrophotographic photosensitive member by using a developer;

a developer frame for containing the developer and having a supply opening, through which the developer is supplied to said developing roller;

a seal member attached to said developer frame and adapted to close said supply opening of said developer frame, thereby sealing the developer in said developer frame;

a first electrode provided along a longitudinal direction of said developing roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that the main body detects a developer amount, said seal member is removable, leaving an attached portion thereof when removed which is attached to said developer frame, so that said supply opening is unsealable and the developer can be supplied to said developing roller when said seal member is removed, and an upper side of the attached portion of said seal member, which is left after unsealing, is above a lower end of said second electrode.

7. An electrophotographic image forming apparatus for forming an image on a recording medium, said electrophotographic image forming apparatus comprising:

an electrophotographic photosensitive member;

a developing roller for developing a latent image formed on said electrophotographic photosensitive member by using a developer;

a developer frame for containing the developer and having a supply opening through which the developer is supplied to said developing roller;

a seal member attached to said developer frame and adapted to close said supply opening of said developer frame, thereby sealing the developer in said developer frame;

a first electrode provided along a longitudinal direction of said developing roller; and a second electrode provided closer to said supply opening than said first electrode, wherein said first and second electrodes are arranged at such positions that the developer can enter therebetween, and a capacitance between said second and first electrodes which is generated when a voltage is applied to said second electrode is detected so that a main body of said electrophotographic image forming apparatus detects a developer amount, said seal member is removable, leaving an attached portion thereof when removed which is attached to said developer frame, so that said supply opening is unsealable and the developer can be supplied to said developing roller when said seal member is removed, and an upper side of the attached portion of said seal member, which is left after unsealing, is above a lower end of said second electrode.

8. A developer frame for a developing device, which is detachably mountable in a main body of an electrophotographic image forming apparatus to develop an electrostatic latent image formed on an electrophotographic photosensitive member by a developing roller, and has developer amount detecting means, having a first electrode provided along a longitudinal direction of said developing roller and a second electrode provided closer to a supply opening of said developing frame than said first electrode, said first and second electrodes being arranged at such positions that a developer can enter therebetween, for detecting a capacitance between said second and first electrodes which is generated when a voltage is applied to said second electrode so that the main body detects a developer amount, wherein said developer frame contains the developer and has said supply opening, through which the developer is supplied to said developing roller, and wherein said developer frame has a seal member attached to said developer frame and adapted to close said supply opening of said developer frame, thereby sealing the developer in said developer frame, said seal member is removable, leaving an attached portion thereof when removed which is attached to said developer frame, so that said supply opening is unsealable and the developer can be supplied to said developing roller when said seal member is removed, and an upper side of the attached portion of said seal member, which is left after unsealing, is above a lower end of said second electrode.

9. A process cartridge according to claim 1 or 5, further comprising a developer feeding member for feeding the developer contained in said developer frame through said supply opening toward said developing roller, wherein the developer fed by said developer feeding member enters between said first electrode and said second electrode.

10. A developing device according to claim 2 or 6, further comprising a developer feeding member for feeding the developer contained in said developer frame through said supply opening toward said developing roller, wherein the developer fed by said developer feeding member enters between said first electrode and said second electrode.

11. An electrophotographic image forming apparatus according to claim 3 or 7, further comprising a developer feeding member for feeding the developer contained in said developer frame through said supply opening toward said developing roller, wherein the developer fed by said developer feeding member enters between said first electrode and said second electrode.

12. A developer frame according to claim 4 or 8, further comprising a developer feeding member for feeding the developer contained in said developer frame through said supply opening toward said developing roller, wherein the developer fed by said developer feeding member enters between said first electrode and said second electrode.

13. A process cartridge according to claim 1 or 5, further comprising a third electrode provided on a bottom of said developing frame, wherein the main body detects a value of the capacitance between said second and third electrodes so that the main body can detect the developer amount.

14. A developing device according to claim 2 or 6, further comprising a third electrode provided on a bottom of said developer frame, wherein the main body detects a value of the capacitance between said second and first electrodes and a value of a capacitance between said second and third electrodes so that the main body can detect the developer amount.

15. An electrophotographic image forming apparatus according to claim 3 or 7, further comprising a third electrode provided on a bottom of said developing frame, wherein said main body detects a value of the capacitance between said second and first electrodes and a value of a capacitance between said second and third electrodes so that said main body can detect the developer amount.

16. A developer frame according to claim 4 or 8, further comprising a third electrode provided on a bottom of said developing frame, wherein the main body detects a value of the capacitance between said second and first electrodes and a value of a capacitance between said second and third electrodes so that the main body can detect the developer amount.

17. A process cartridge according to claim 1 or 5, wherein the main body detects a value of a capacitance between said developing roller and said first electrode to detect a developer run-out state.

18. A developing device according to claim 2 or 6, wherein the main body detects a value of a capacitance between said developing roller and said first electrode to detect a developer run-out state.

19. An electrophotographic image forming apparatus, in which a process cartridge is detachably mountable for forming an image on a recording medium, the process cartridge being detachably mountable in a main body of said electrophotographic image forming apparatus and comprising an electrophotographic photosensitive member, a developing roller for developing a latent image formed on the electrophotographic photosensitive member by using a developer, a developer frame for containing the developer and having a supply opening, through which the developer is supplied to the developing roller, a first electrode provided along a longitudinal direction of the developing roller, and a second electrode provided closer to the supply opening than the first electrode, wherein the first and second electrodes are arranged at such positions that the developer can enter therebetween, and a capacitance between the second and first electrodes, which is generated when a voltage is applied to the second electrode, is detected so that said main body detects a developer amount, and the developer frame is arranged such that a lower end portion on an upper side of the supply opening of the developer frame is above a lower end of the second electrode, said electrophotographic image forming apparatus comprising:

(i) a mounting portion, in which the process cartridge is detachably mountable; and (ii) detecting means for detecting a value of the capacitance to detect the developer amount.

20. An electrophotographic image forming apparatus, in which a process cartridge is detachably mountable for forming an image on a recording medium, the process cartridge being detachably mountable in a main body of said electrophotographic image forming apparatus and comprising an electrophotographic photosensitive member, a developing roller for developing a latent image formed on the electrophotographic photosensitive member by using a developer, a developer frame for containing the developer and having a supply opening, through which the developer is supplied to the developing roller, a seal member attached to the developer frame and adapted to close the supply opening of the developer frame, thereby sealing the developer the developer frame, a first electrode provided along a longitudinal direction of the developing roller, and a second electrode provided closer to the supply opening than the first electrode, wherein the first and second electrodes are arranged at such positions that the developer can enter therebetween, and a capacitance between the second and first electrodes which is generated when a voltage is applied to the second electrode is detected so that the main body detects a developer amount, the seal member is removable, leaving an attached portion thereof when removed which is attached to the developer frame, so that the supply opening is unsealed and the developer can be supplied to the developing roller, and an upper side of the attached portion of the seal member, which is left after unsealing, is above a lower end of the second electrode, said electrophotographic image forming apparatus comprising:

(i) a mounting portion, in which the process cartridge is detachably mountable; and (ii) detecting means for detecting a value of the capacitance to detect the developer amount.

* * * * *

UNITED STATES PATENT AND TRADEMARK OFFICE

CERTIFICATE OF CORRECTION

PATENT NO. : 6,587,650 B2
DATED : July 1, 2003
INVENTOR(S) : Akiyoshi Yokoi et al.

It is certified that error appears in the above-identified patent and that said Letters Patent is hereby corrected as shown below:

Title page,
Item [56], References Cited, FOREIGN PATENT DOCUMENTS,
"2001092232 A" should read -- 2001-092232 A --, and
"2001117344 A" should read -- 2001-117344 A --.

Column 11,
Line 43, "developer" should read -- developing --.

Signed and Sealed this

Eleventh Day of November, 2003

JAMES E. ROGAN
*Director of the United States Patent and Trademark Office*